US005145254A

United States Patent [19]

Hovstadius

[11] Patent Number: 5,145,254

[45] Date of Patent: Sep. 8, 1992

[54] MIXER DEVICE

[75] Inventor: Gunnar Hovstadius, Sigtuna, Sweden

[73] Assignee: ITT Flygt AB, Solna, Sweden

[21] Appl. No.: 766,235

[22] Filed: Sep. 24, 1991

[30] Foreign Application Priority Data

Oct. 5, 1990 [SE] Sweden ..... 9003188

[51] Int. Cl.[5] ..... B01F 7/06

[52] U.S. Cl. ..... 366/286

[58] Field of Search ..... 366/277, 241, 279, 348, 366/349, 331, 280, 281, 282, 286, 284, 285, 261; 415/213.1; 210/87; 52/27, 126 S, 169.9, 299

[56] References Cited

U.S. PATENT DOCUMENTS 586,983 7/1897 Wharton, Jr. ..... 366/261
4,431,597 2/1984 Cramer ..... 366/285
4,540,290 10/1985 Jarvinen ..... 366/286
4,581,182 4/1986 Cramer ..... 366/261
4,671,872 6/1987 Cramer ..... 366/285

FOREIGN PATENT DOCUMENTS 456222 8/1966 Japan ..... 366/279

*Primary Examiner*—Philip R. Coe
*Assistant Examiner*—Randall Edward Chin
*Attorney, Agent, or Firm*—Menotti J. Lombardi

[57] ABSTRACT

At the bottom of the tank there are provided supports (4), (5), while the under side of the mixer is provided with corresponding surfaces (6), (7) for receiving the supports. In order to prevent the reaction force from the propeller (2) from tilting the front end of the mixer upwards, at least one of the supports (5) is arranged at a level above the level of the propeller shaft.

1 Claim, 1 Drawing Sheet

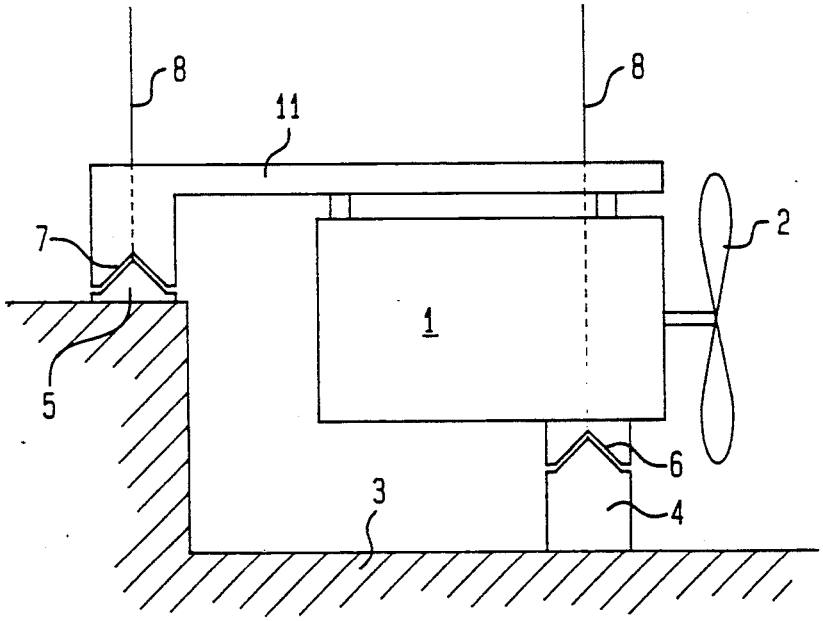
8
8
11
7
2
1
5
6
3
4

MIXER DEVICE

BACKGROUND OF THE INVENTION

The invention concerns a device for an easily releasable connection of a submersible mixer within a liquid tank.

In tanks containing liquids with large amounts of solid bodies, mixers are often used to prevent sedimentation and to secure that the liquid is kept homogeneous. A type of mixer which has become very common for this purpose is the so-called submersible mixer which comprises an electric motor with or without a gear box and a propeller. The machine is normally arranged to be lowered along a vertical guide which is mounted within the tank in a suitable way. The advantage with this machine is above all that it is very easy to take up for service and in addition it is very easy to arrange in different directions by turning of the guide. A device of this type is shown in, Swedish Patent No. 8502389-3 (U.S. Pat. No. 4,687,175).

When the mixer operates, a considerable reaction force from the propeller occurs which tries to press the mixer backwards and possibly tilt it upwards. By a suitable dimensioning of the guide and the connection between the latter and the mixer, this force can be taken care of and the mixer retains its preferred position.

The known device mentioned above has the disadvantage that it is relatively expensive and thus, it has been a desire to replace it by a more simple device when the conditions are such that the mixer is meant to operate in one position only, without having the possibility to turn. A device of this type is shown in DE P 3900 630.1. Here, the guide is designed like a tripod and is attached to the bottom of the tank, the mixer being lowered to its operating position on a shelf adjacent the branching of the guide. In order to stand the reaction force from the propeller, the guide system must be very rigid which means costs, especially if the tank contains corrosive liquid which calls for parts made of stainless steel.

According to the invention, the above mentioned problems have been solved by means of the device disclosed herein.

SUMMARY OF THE INVENTION

An object of the invention is to provide a device for an easily releasable mounting of a submersible mixer in a liquid tank.

At the bottom of the tank there are provided support means while the under side of the mixer is provided with complimentary means for receiving the supports, and to prevent the reaction force from the propeller from tilting the front end of the mixer upwards, at least one of the support means is arranged at a level above the level of the propeller shaft.

BRIEF DESCRIPTION OF THE DRAWING

The invention will become more apparent by reference to the accompanying sole drawing which is a side view of the mixing device.

DETAILED DESCRIPTION OF THE PREFERRED EMBODIMENT

Referring to the drawing there is shown a motor 1, a propeller 2, a tank bottom 3, support means 4, 5, complimentary surfaces 6, 7 in the frame and rack of the mixer, and guide wires 8. The frame of motor 1 has a cone-formed shell 6 which extends from the bottom of the motor adjacent the propeller. A rack 11 is connected to the top of the frame of motor 1 and extends downward near the end opposite the propeller and has a cone-formed shell 7.

At the bottom of the tank the supports 4 and 5 are cone-shaped and arranged so that the mixer will rest on them during operation. In order to guide the mixer towards the supports during its lowering, the supports are provided with guide wires 8, which extend vertically upwards to the brim of the tank and which go through openings in the complimentary surfaces 6, 7 and the frame of the surfaces 6, 7 are formed as complimentary cone-formed shells which mate to the supports 4, 5. When the mixer stands rigidly on the supports after having been lowered along the guide wires 8, the wires may then be moved aside and retained against the wall of the tank in order not to disturb the mixing process.

In order to insure that the reaction force from the propeller 2 will not cause the device to tilt upwards, support means 5 is situated away from the propeller and is placed at a higher level than the support means 4 adjacent the propeller and also above the level of the propeller shaft. Thus the reaction force from the propeller will act below the support means 5 and press the mixer downwards instead of tilting it upwards.

The great advantage with the device is that a simple and stable support of the mixer is obtained when no changing of the inclination of the mixer is desired. Also, the guiding of the mixer towards its operating position along the guide wires is a non-expensive solution as compared with the guide pipes which are normally used.

What is claimed is:

1. Apparatus for an easily releasable mounting of a submersible mixer on a tank bottom comprising in combination:

an electric motor having a frame and a propeller on a substantially horizontal driving shaft, the frame of said motor having a cone-formed shell which extends from the bottom of the motor adjacent the propeller end;

a rack being connected to the top of the frame of the motor, said rack extending downward near the end opposite of the propeller and having another cone-formed shell;

a cone-formed support being positioned on the tank bottom to engage corresponding surfaces in said cone-formed shell;

another cone-formed support being positioned on the tank bottom at a level higher than said cone-formed support and said shaft, said other cone-formed support to engage corresponding surfaces in said other cone-formed shell, thereby preventing the reaction force from the propeller to raise the front end of the mixer during operation; and a wire being connected to each said cone-formed and other cone-formed supports to permit said mixer to be lowered and raised.

* * * * *